US005434601A

United States Patent [19]

Nobumori

[11] Patent Number: 5,434,601

[45] Date of Patent: Jul. 18, 1995

[54] PAPER FEED CONTROL SYSTEM

[75] Inventor: Shogo Nobumori, Ibaraki, Japan

[73] Assignee: Hitachi Koki Co., Ltd., Tokyo, Japan

[21] Appl. No.: 35,494

[22] Filed: Mar. 19, 1993

Related U.S. Application Data

[63] Continuation of Ser. No. 690,484, Apr. 24, 1991, abandoned.

[30] Foreign Application Priority Data

Apr. 27, 1990 [JP] Japan ..... 2-113008

[51] Int. Cl.[6] ..... B41J 2/435

[52] U.S. Cl. ..... 346/134

[58] Field of Search ..... 346/1.1, 108, 107 R, 346/76 L, 134, 160; 355/311, 319

[56] References Cited

U.S. PATENT DOCUMENTS

| | | | |
|---|---|---|---|
| 4,348,101 | 9/1982 | Schonfeld | 355/319 |
| 4,956,717 | 9/1990 | Suzuki et al. | 355/319 |
| 4,974,034 | 11/1990 | Rabb et al. | 355/319 |
| 5,026,037 | 6/1991 | Masuda | 355/319 |
| 5,126,786 | 6/1992 | Tanaka | 355/311 |

*Primary Examiner*—Mark J. Reinhart
*Attorney, Agent, or Firm*—Sughrue, Mion, Zinn, Macpeak & Seas

[57] ABSTRACT

In a paper feed control system for a cut sheet-double side printing laser printer having a paper feed portion for stacking a plurality of paper sheets cut to a predetermined size; a paper feed mechanism for feeding the paper sheets one by one from the paper feed portion; a printing mechanism portion for printing first page data to one surface of the paper sheet, fed from the paper feed mechanism, by an electrophotographic means; and a return feed path which in order to print second page data to the other surface of the paper sheet, inverts the front and reverse surfaces of the paper sheet having the printed surface so as to selectively feed the paper sheet again to the printing mechanism portion. A plurality of feed roller mechanisms are provided which can be driven independently of one another so that the speeds of travel of a plurality of paper sheets in the feed path are changed independently of one another in accordance with the condition of the printer device or a host device.

5 Claims, 3 Drawing Sheets

PAPER FEED CONTROL SYSTEM

This is a Continuation of Application Ser. No. 07/690,484 filed Apr. 24, 1991 abandoned.

BACKGROUND OF THE INVENTION

This invention relates to a paper feed control system for a page printer such as a cut sheet-double side printing laser printer which carries out continuous full-page printing.

First, the operation of a conventional cut sheet-double side printing laser printer will be described with reference to FIG. 3. FIG. 3 shows the overall construction of the cut sheet-double side printing laser printer according to the prior art. Paper sheets are stacked in a paper feed hopper 1. When printing data is fed from a host computer system to the printer, the printer makes necessary preparations for the printing, such as the rotation of a photosensitive drum and etc., at the same time begins to process the printing data to develop the same into on-off information ( dot information) of the laser. When the printing preparations are completed after the dot development is finished, a paper feed roller 3 is driven, and an uppermost one of the paper sheets stacked in the paper feed hopper 1 is fed therefrom. The paper sheet thus fed from the paper feed hopper 1 is fed through feed rollers 5 to 8 into a printing mechanism 9. A toner image transferred onto the paper sheet in the printing mechanism 9 is fixed at a fixing device 10. In the case of a one-side printing mode, the paper sheets thus subjected to the fixing are sequentially discharged into a paper stacker 11, and are stacked therein. The type of stacker, in which at this time the paper sheets are stacked in such a manner that the printed results are arranged in the order of the printing with their printed surfaces directed downward, as illustrated, is commonly called a face down stacker.

In the case of a double-side printing mode, a gate switching operation is effected immediately before the paper which has been sheet subjected to a one-side printing arrives at a path switching gate 12, and the paper sheet is sent to a switch back portion 13. The leading and trailing edges of the paper sheet are reversed at the switch back portion 13, and the paper sheet is sent into a return hopper 14 via a return feed path. The paper sheet is stopped for a moment at the return hopper 14, and waits until the dot development of the reverse surface printing data is completed. When the dot development is completed, a return paper feed roller 15 is driven, and the paper sheet is sent out of the return hopper 14, and again passes through the printing mechanism 9 and the fixing device 10, so that the reverse surface data is transferred and fixed. The paper sheet subjected to the double-side printing is discharged to the paper stacker 11, so that the inverted stacking is effected as described above for the one-side printing mode. Namely, in the case of the double-side printing mode, the stacking is carried out in such a manner that the printing result obtained secondly is disposed at the lower side to provide the first page. Therefore, in the double-side printing mode, generally, the printing order is changed in the printing control device in such a manner that the even number page is first printed, and then the odd number page is printed.

As shown in the drawings, the return feed path needs to have a length at least corresponding to the length of one paper sheet, and usually has a length corresponding to the total length of 4 to 10 paper sheets because the fixing device, a resist mechanism, etc., are provided at the return feed path. Therefore, when the front and reverse surfaces of one paper sheet are to be continuously printed, the waiting time from the end of the printing of the even number page to the start of the printing of the odd number page corresponds to a time period during which several pages can be printed. Thus, the printing speed of the printer is greatly lowered. Therefore, it is a common practice that during the time when the paper sheet whose even number page has been printed is traveling along the return feed path, a subsequently-fed paper sheet is printed if the printing data for this subsequent paper sheet has been received.

Namely, when the printing is to be continuously carried out in the double-side printing mode, the even number page (second page) of a first paper sheet is first printed, and then before the first page of this first paper sheet is printed, subsequent fourth and sixth pages are printed, thereby preventing the total printing speed from being lowered.

However, this means that even when the printing data is received from the host device, the printer can not carry out the printing immediately and that it is necessary to temporarily store the data for several pages by a storage means such as a memory.

A conventional method of decreasing the capacity of the memory for storing the dot data after the dot development is to effect the dot development in the order of printing of the pages.

The dot development time for one page varies depending on the printing data, and usually graphic data requires a longer time than character data. Therefore, when the time required for the dot development of the odd number page is longer than the time required for the return of the paper sheet, the paper sheet is caused to stand by at the above return hopper portion to wait for completion of the dot development.

Here, in the above case, that is, during the time when the printing is carried out in the order of the 2nd, 4th, 6th, 1st, 3rd and 5th pages, let's assume that the dot development for the 1st page requires a relatively long time. The three paper sheets are fed from the paper feed hopper 1, and the 2nd, 4th and 6th pages are printed, and the three paper sheets are sequentially sent to the return hopper 14 via the return feed path.

Namely, when the dot development time for the 1st page is long, all three paper sheets are stacked in the return hopper portion. Therefore, the return hopper 14 must be able to stack a plurality of paper sheets, and also must again feed the stacked paper sheets one by one in the order of stacking.

Incidentally, when considering a stable travel (high-precision travel without jamming) of paper sheets which is the most important of all the basic performances of the printer, paper feed problems conventionally occurs most frequently when the paper sheets are separately fed one by one from the paper stack portions (i.e., the paper feed hopper 1 and the return hopper 14).

Namely, at the other portions, the paper sheet already separated is fed by the upper and lower rollers. In contrast, the paper sheets are stacked in intimate contact with adjacent ones in the paper feed hopper 1 and the return hopper 14, and therefore there is a high possibility that two or more paper sheets may be fed simultaneously therefrom. Furthermore, because of the friction feed applied to only one surface of the paper sheet, the paper sheet may greatly slip, which results in problems that the printing position is displaced and that the paper sheet is liable to become jammed. Particularly in the case of the return hopper 14 in the above double-side printing device, static charges develop on the paper sheet at the time of the one-side printing, and therefore the paper sheets can not be easily separated front one another.

In order to overcome double sheet feeding due to incomplete paper separation and the paper feed problems due to the paper slip, various paper separation mechanisms and slipless paper feed mechanisms have heretofore been proposed.

However, none of them have been 100% effective because of the limitation on the overall size of the printing device and other reasons.

SUMMARY OF THE INVENTION

The present invention has been made in view of the above problems, and an object of the invention is to prevent the displacement of the printing position even when paper slip page occurs at a paper feed hopper, and also to obviate the need for a return hopper in a double-side printing mode, thereby reducing potential problems.

According to the present invention, in a cut sheet-double side printing laser printer, feed roller mechanisms are driven independently of one another so that the speeds of travel of a plurality of paper sheets in a feed path can be changed independently of one another. With this method, even if a paper feed delay occurs at the paper feed portion, the position displacement can be prevented, and further the waiting for the dot development in a double-side printing mode can be carried out without stacking the paper sheets, thus obviating the need for a return hopper.

BRIEF DESCRIPTION OF THE DRAWINGS

FIGS. *2a–2c* are schematic views showing a paper stand-by condition in a return feed path in a double-side printing mode.

DETAILED DESCRIPTION OF THE PREFERRED EMBODIMENTS

Figure 1:
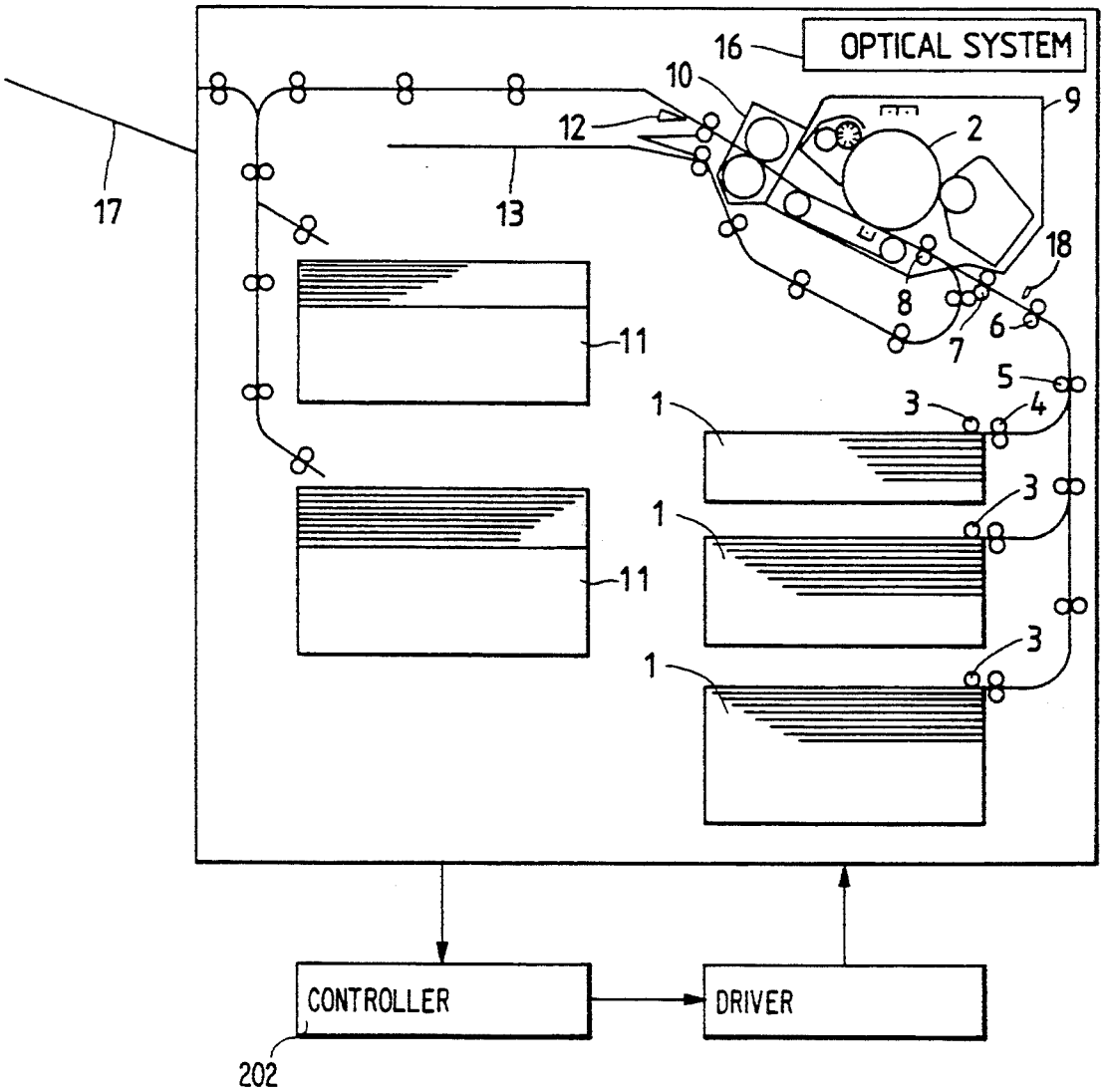
FIG. 1 is a vertical cross-sectional view of one preferred embodiment of a cut sheet-double side printing laser beam printer of the present invention.
Figure 2A:
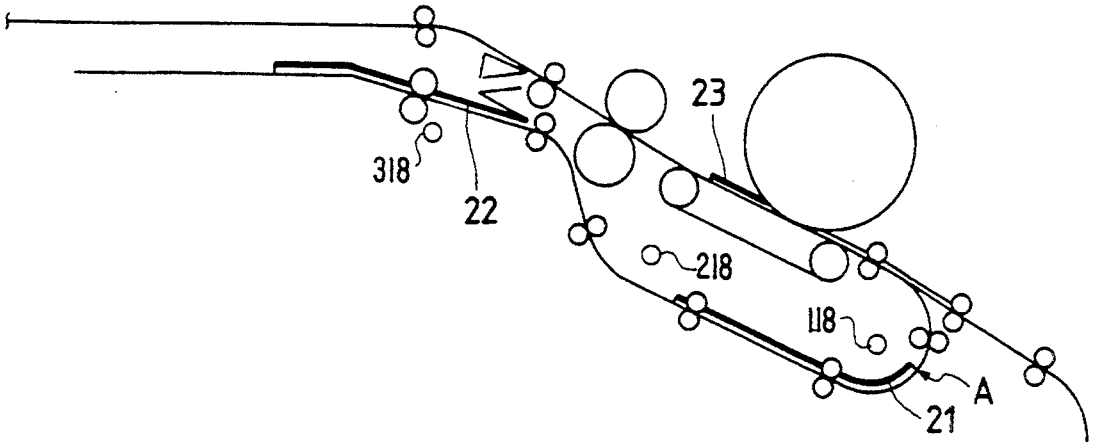
Figure 2B:
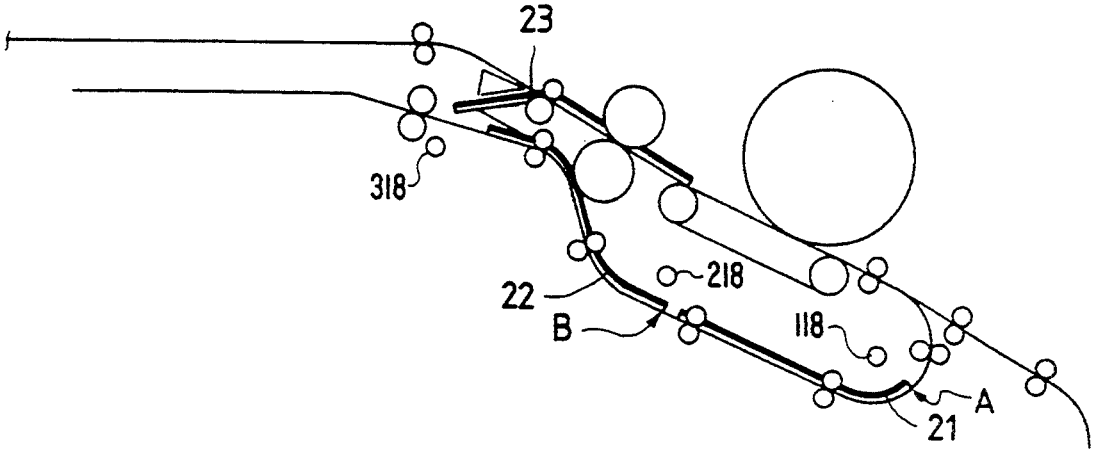
Figure 2C:
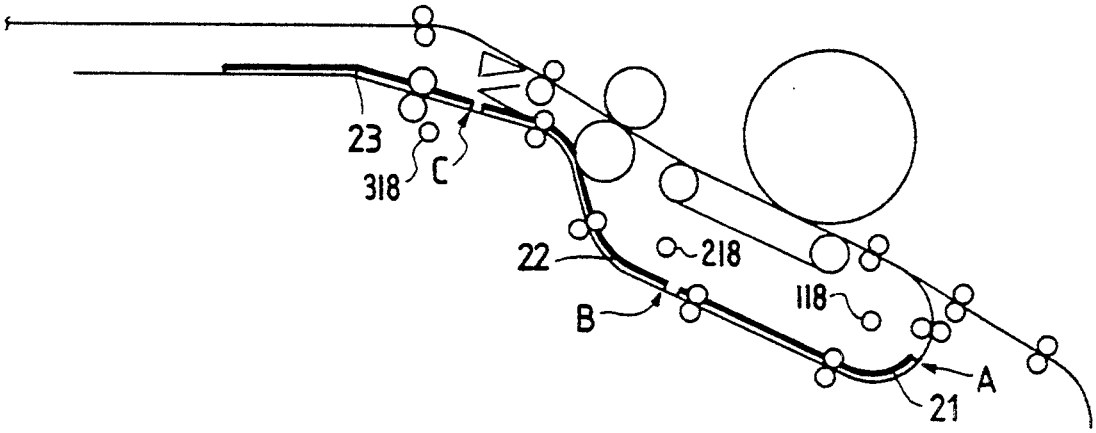
Figure 3:
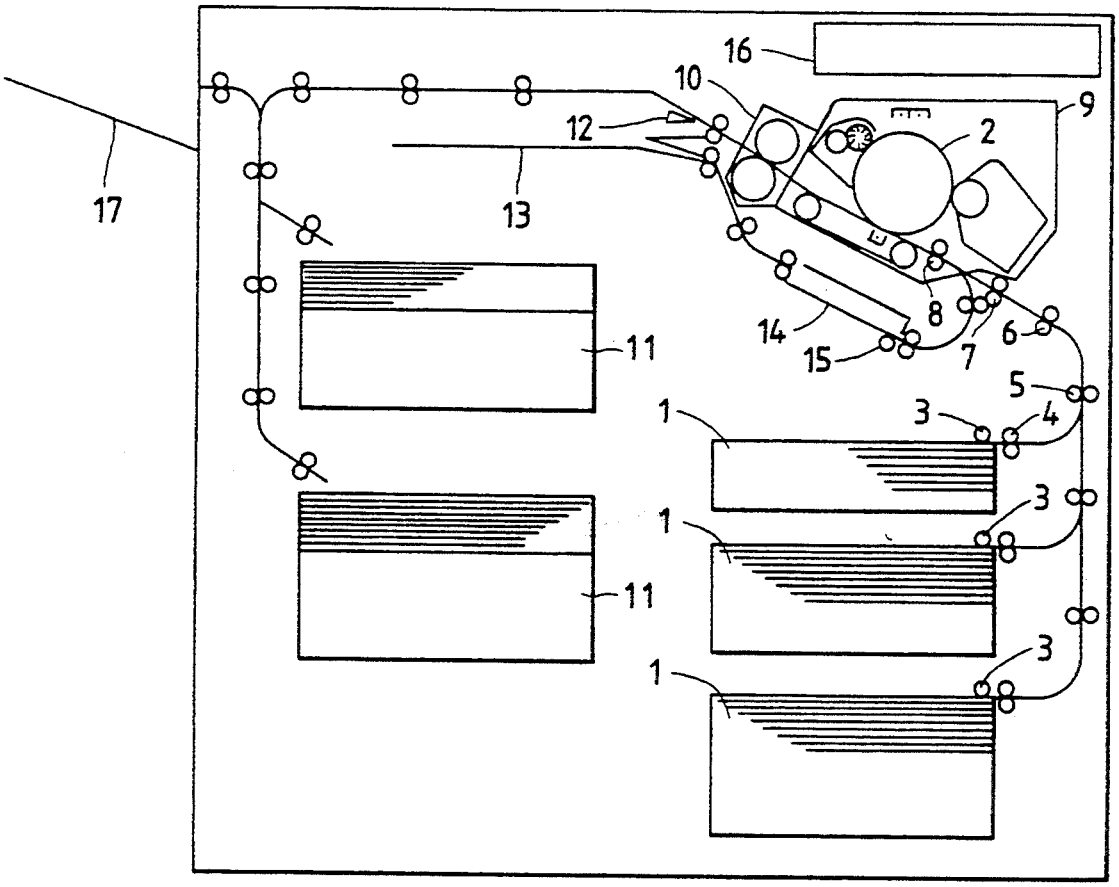
FIG. 3 PRIOR ART
FIG. 3 is a vertical cross-sectional view showing the overall construction of a conventional cut sheet-double side printing laser beam printer.

A preferred embodiment of the invention shown in FIGS. 1 and 2 will now be described in detail. FIG. 1 is a block diagram of one preferred embodiment of a cut sheet-double side printing laser beam printer of the present invention. FIGS. *2a–2c* show a paper stand-by condition in a return feed path in a double-side printing mode. Feed rollers have separate drive sources, respectively, so that their speeds can be changed independently of one another, and the printing is carried out by a paper feed control similar to that of the above-mentioned prior art device.

Reference is first made to the control of the present invention carried out when a paper sheet at a paper feed hopper 1 slips. After a paper feed roller 3 begins to be driven, a control portion monitors the timing of arrival of the leading edge of the paper sheet at a paper sensor 18 so as to measure a time deviation from an expected timing. If the amount of this time deviation is greater than a predetermined value, the speeds of feed rollers 5 and 6 are changed so that the predetermined timing can be obtained so as to correct the position of the paper sheet before the paper sheet reaches the next stage feed roller 7.

Next, reference is made to the stand-by of the paper sheets in the return feed path. In the above example, FIG. 2 shows the condition in which a 2nd page is already printed, and the first-fed paper sheet resides in the return feed path in order that a 1st page is to be printed on the reverse surface of this paper sheet.

In FIG. *2a,* the first-fed paper sheet 21 has reached the position A, and waits for the finish of the dot development, stored as data in a memory for the 1st page. At this time, a secondly-fed paper sheet 22 is moving in a switch back portion, and a thirdly-fed paper sheet 23 is moving in a printing mechanism portion.

In FIG. *2b,* the position of the paper sheet 21 is not changed because the dot development for the 1st page is not yet completed, but the paper sheets 22 and 23 advance, and the leading edge of the paper sheet 22 reaches the position B. The control portion detects the stop of the paper sheet 21 at the position A and the arrival of the paper sheet 22 at the position B by virtue of detectors 118 and 218, respectively, and stops the driving of the feed rollers holding the paper sheet 22 therebetween. Then, in FIG. *2c,* only the paper sheet 23 is fed, and therefore the leading edge of the paper sheet 23 reaches the position C.

The control portion detects the stop of the paper sheet 22 at the position B and the arrival of the paper sheet 23 at the position C by virtue of detector 318, and stops the driving of the feed rollers holding the paper sheet 23 therebetween.

At the time when the dot development for the 1st page is finished, these paper sheets are advanced, and the printing is applied to the paper sheet 21, and the paper sheets 22 and 23 wait at respective advanced positions for the dot development for their pages. The feed rollers are independently driven by a known device such as driver 200 which is controlled by controller 202.

In the present invention, the paper slip at the paper feed hopper can be corrected. And besides, even if the dot development for the odd number page is delayed, there is no need to stack the paper sheet, and the paper sheet held between the independent feed rolls can stand by. Therefore, the need for a return hopper is obviated, and the reliability of the printing device can be enhanced.

What is claimed is:

1. A paper feed device for a cut sheet double side printing apparatus, comprising:

means for stacking a plurality of paper sheets;

means for feeding the paper sheets one by one from said stacking means;

means for printing first page data onto one surface of one of the paper sheets, fed from said feeding means;

a return feed path which, in order to print second page data to the other surface of said one of the paper sheets, inverts said one of the paper sheets so as to selectively feed said one of the paper sheets again to said printing means;

a plurality of feed roller means disposed in said return feed path for feeding the paper sheets through said return feed path;

a plurality of detectors provided at different positions in said return feed path for detecting the position of the paper sheets in said return feed path; and means for controlling said feed roller means so as to stop the paper sheets at respective positions in said return feed path to wait until page data dot development is completed when preparations for page data dot development is not completed.

2. A paper feed control device according to claim 1, wherein said controlling means stops said feed roller means until the development of page data in a page memory is completed.

3. A paper feed control method for a cut sheet double side printing apparatus having a plurality of feed mechanisms located in a paper feed path, said method comprising the step of:

recognizing the completion of dot development of page date into a memory;

detecting a position of the paper at a certain time; and stopping the operation of at least one of said feed mechanisms until the dot development of page data into a memory has been completed.

4. A paper feed device for a cut sheet double side printing apparatus, comprising:

means for feeding a paper sheet;

sheet detection means for detecting said paper sheet fed by said feeding means;

means for comparing an actual timing of paper feed detected by said sheet detection means with an expected timing; and means for changing a paper feed speed when said actual timing deviates from the expected timing by more than a predetermined value.

5. A paper feed control method for a paper feed device including a plurality of paper sheet feeding means, a sheet detection means for detecting a sheet fed by said sheet feeding means, a comparison means for comparing an actual timing of paper feed detected by said sheet detection means with an expected timing, said method of comprising the steps of:

varying a speed of sheet feeding to until a paper sheet reaches the downstream sheet feeding means to correct a position of the sheet when said actual timing is different than the expected sheet timing so that the sheet feed speed is based on said expected timing.

* * * * *